US011186398B2

(12) United States Patent
Burchett et al.

(10) Patent No.: US 11,186,398 B2
(45) Date of Patent: Nov. 30, 2021

(54) AUTOMATED CARTON CLOSING AND CONVEYING DEVICE

(71) Applicant: UNITED STATES GYPSUM COMPANY, Chicago, IL (US)

(72) Inventors: David Burchett, Aliquippa, PA (US); Doug Wilson, Monaca, PA (US); Christopher Hovanec, Aliquippa, PA (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 254 days.

(21) Appl. No.: 16/533,471

(22) Filed: Aug. 6, 2019

(65) Prior Publication Data

US 2021/0039817 A1 Feb. 11, 2021

(51) Int. Cl.

*B65B 51/02* (2006.01)
*B65B 57/02* (2006.01)
*B65B 7/20* (2006.01)

(52) U.S. Cl.

CPC ..... *B65B 51/023* (2013.01); *B65B 7/20* (2013.01); *B65B 57/02* (2013.01)

(58) Field of Classification Search

CPC . B65B 43/52; B65B 43/39; B65B 51/02–026; B65B 7/20; B65B 23/20; B65B 51/144; B65B 51/16; B65B 57/02; B65B 59/001; B65B 59/003; B65B 59/005; B65G 21/20; B65G 21/2072; B65G 15/46; B65G 39/18; B65G 2201/025

USPC ..... 193/35 C; 198/836.1, 836.3; 53/382.1, 53/382.3

See application file for complete search history.

(56) References Cited

U.S. PATENT DOCUMENTS 2,135,806 A * 11/1938 Fermann ..... B65B 51/18 53/376.5
2,390,120 A * 12/1945 Peters ..... B31C 1/02 493/128
2,915,868 A * 12/1959 Copping ..... B65B 43/39 53/382.3
2,982,076 A * 5/1961 Shelton ..... B65B 43/39 53/382.1
2,987,973 A * 6/1961 Chandler ..... B65B 7/24 493/137
3,088,433 A 5/1963 Walter et al.
3,121,300 A * 2/1964 Rossi ..... B65C 1/045 53/50
3,708,951 A 1/1973 Folk et al.
3,775,937 A 12/1973 Devan et al.
3,821,875 A 7/1974 Paxton
3,885,372 A * 5/1975 Peres ..... B65B 51/02 53/75

(Continued)

*Primary Examiner* — Joshua G Kotis

(74) *Attorney, Agent, or Firm* — Greer, Burns & Crain, Ltd.; Philip T. Petti; Pradip Sahu

(57) ABSTRACT

A device is provided for closing, sealing and conveying corrugated cartons having a top flap and a next adjacent flap, and includes a frame, a moving conveyor belt associated with the frame and defining a track with an inlet end and an outlet end, and a fixed bracket secured to the frame and having a first plurality of linearly aligned rollers defining a first side of the track. A movable bracket is associated with the frame, having a second plurality of linearly aligned rollers defining a second side of the track and being transversely movable relative to the track under operator control.

15 Claims, 9 Drawing Sheets

(56) References Cited

U.S. PATENT DOCUMENTS

| | | | | | |
|---|---|---|---|---|---|
| 3,894,380 | A | * | 7/1975 | Poulsen | B65B 51/02 53/75 |
| 3,999,470 | A | * | 12/1976 | Bowser | B65B 7/20 493/182 |
| 4,010,597 | A | * | 3/1977 | Nelson | B65B 7/20 53/376.5 |
| 4,263,766 | A | * | 4/1981 | Baker | B65B 61/26 101/27 |
| 4,778,554 | A | | 10/1988 | Doman | |
| 5,115,625 | A | * | 5/1992 | Barbulesco | B65B 7/20 53/467 |
| 5,255,490 | A | * | 10/1993 | Chiu | B29C 66/841 53/136.4 |
| 6,070,396 | A | | 6/2000 | Rinaldi et al. | |
| 6,152,293 | A | * | 11/2000 | Ballos, III | B65G 21/10 198/836.1 |
| 6,226,965 | B1 | | 5/2001 | Lam | |
| 8,109,062 | B2 | | 2/2012 | Chase et al. | |
| 8,499,530 | B2 | | 8/2013 | Fisher et al. | |
| 2011/0197551 | A1 | | 8/2011 | Book et al. | |
| 2015/0291295 | A1 | | 10/2015 | Langen | |

* cited by examiner

AUTOMATED CARTON CLOSING AND CONVEYING DEVICE

BACKGROUND

The present invention relates generally to carton sealing devices, and particularly to such devices used for packaging long, narrow products, and more specifically to such devices which also convey the sealed carton to a desired location for shipping.

In factories producing long, thin items, including wallboard corner bead, interior trim such as quarter round, ceiling tile grid brackets, elongate wooden, metal and/or plastic trim pieces and the like, unusually long, narrow corrugated cartons are employed. In many cases, these cartons have lengths at least 6 feet long, and often range up to as long as 12 feet to account for tall ceiling construction in some residential and commercial space. For products having longer lengths in these ranges, the filled cartons are often heavier than 50 pounds. Many manufacturing companies have adopted work rules that forbid individual employees from lifting more than 50 pounds at a time. Teams of workers are required to transport such cartons within the plant. Regardless of the weight limit, the filled, elongate cartons are cumbersome to handle once they are sealed.

Another problem associated with such elongate cartons is maintaining them aligned or "square" as the product is loaded into the carton and the carton is sealed for shipment. The long, unwieldy cargo of these cartons readily shifts during packing, and makes it difficult for the packer to hold the panels and flaps in place at the same time that adhesive and/or packing tape is applied. A related problem is that it is difficult for the packer to coordinate the sealing of both ends of the carton to achieve a properly aligned or "square" carton.

Thus, there is a need for an improved device for sealing and conveying elongate cartons to shipment locations, such as shipping pallets, stacks of like cartons, truck beds or the like.

SUMMARY

The above-listed need is met or exceeded by the present automated carton closing and conveying device, which defines a track with an inlet end through which a loaded, assembled yet unsealed carton is inserted. In the preferred embodiment, the track is located at or adjacent to a work table height for the convenience of packers. Multiple rows of aligned rollers define spaced sides and a top of the track, which has at its floor a moving endless conveyor belt. In the preferred embodiment, the endless conveyor belt is textured or ribbed for enhanced traction as is well known in the art.

As the belt pulls the loaded carton through the track, the device is constructed and arranged to automatically manipulate an uppermost, upper or top carton flap so that the flap is held open, adhesive is injected between the top flap and a next adjacent flap, a specialized roller presses the top flap into position, and downstream upper and side rollers maintain the carton in a proper, aligned or "square" shape until the adhesive sets. At the outlet end of the track, the completed carton is ejected by the moving conveyor belt and is deposited automatically on a shipping pallet or other desired location, with reduced effort by the packer.

Also included on the device are sensors constructed and arranged so that the conveyor belt begins to move, and/or adhesive is only injected or applied when a carton is present.

In the preferred embodiment, multiple sensors are triggered before the adhesive is applied.

Included in the present device are three main brackets that are connected by cross members and linear sliding bearings. Two external brackets hold the whole device together, and a third bracket is mounted between the external brackets. To provide adjustability in the width of the track receiving the cartons, the middle bracket slides laterally on the linear bearings and is adjustable by the packer. Preferably, the middle bracket is preferably made of "[" or "C" channel. Also, the middle bracket has a plurality of rollers spaced evenly along a longitudinal axis that define one side of the track. On the stationary side of the track, a similar plurality of rollers is provided, preferably with the same roller spacing and sizing.

In the preferred embodiment, an adjuster wheel on one side of the device is provided for packer control over the width of the track. An important feature is that the rollers defining the two sides of the track remain tightly engaged to sides of the carton, while still allowing movement of the carton along the track to maintain the desired sealed shape of the carton along its length. Thus, it is important to provide the packer with the ability to adjust the width of the track to properly accommodate a plurality of various carton dimensions.

Preferably situated along a top portion of the device near an inlet end is a flap opener, preferably a tapered roller that separates the top flap of the carton from the next lower flap and positions it at an inclined angle relative to horizontal, so that a gap is defined for insertion of adhesive. Adjacent and slightly "downstream" of the tapered roller is disposed a gluing fixture having an adhesive injector nozzle. Next adjacent the gluing fixture is a relatively larger diameter pressing fixture or pressing roller, which exerts pressure on the top flap to press it against the next lower flap to begin the adhesion process, at the same time the carton is passed through the relatively tight roller track in which the flaps are pressed together on the top, and at the same time the sides of the carton are pressed together by the parallel walls of rollers.

Preferably downstream of the pressing fixture is a third plurality of linearly aligned rollers defining an upper end of the track and constructed and arranged for contacting the corrugated cartons as they move along the track from the inlet end to the outlet end. At least one, and preferably all of the third plurality of rollers is pivotable relative to the track and exerts a weighted force on the cartons as they are moved in the track by the belt.

Another feature of the present device is that it is important that adhesive not be dispensed from the nozzle when cartons are not present. To this end, the device is provided with an encoder that controls the glue application. The encoder is positioned between a pair of linearly displaced sensors located along the direction of travel of the carton through the device. While other sensors are contemplated, optical sensors are preferred. The first sensor, located farthest from the inlet, senses the presence of a carton on the conveyor. Once a carton is sensed, the sensor signals the conveyor motor to begin moving the belt, causing the carton to move past, and be detected by the encoder and the second sensor, located successively closer to the inlet end and which together energize the adhesive injector nozzle.

A significant function of the encoder in this arrangement is relaying the box speed so that a correct amount of adhesive is dispensed from the nozzle. The second or downstream sensor is programmed for enabling and disabling the adhesive injector nozzle.

A third sensor, again preferably a photo-sensor, is disposed at the outlet of the device. As the carton is moved past the end of the roller channel, and is configured for maintaining the conveyor roller energized after the carton has passed the first sensor. As such, after application of the adhesive and appropriate clamping by the rollers, the carton is further conveyed past the device using the continuously moving conveyor belt. Since the cartons are relatively long, if the conveyor belt continues movement until a rear end of the carton passes the roller channel, a front end of the carton will presumptively be on or close to a shipping pallet or other desired location More specifically, a device is provided for closing, sealing and conveying corrugated cartons having a top flap and a next adjacent flap, and includes a frame, a moving conveyor belt associated with the frame and defining a track with an inlet end and an outlet end, a fixed bracket secured to the frame and having a first plurality of linearly aligned rollers defining a first side of the track. A movable bracket is associated with the frame, having a second plurality of linearly aligned rollers defining a second side of the track and being transversely movable relative to the track under operator control.

In another embodiment, a device is provided that is constructed and arranged for receiving, sealing, and transitioning an elongate carton, and includes a conveyor belt defining a track having an inlet end and an outlet end, a first plurality of vertical rollers defining a first side of the track, a second plurality of vertical rollers defining a second side of the track, the pluralities of vertical rollers configured for aligning cartons inserted in the track. A flap opener is located near the inlet end of said track, a gluing fixture is located downstream of the flap opener; and a pressing fixture located downstream of the gluing fixture.

DETAILED DESCRIPTION

Referring now to FIGS. 1-5, the present device for closing, sealing and conveying corrugated cartons is generally designated 10. It is contemplated that the device 10 is located on a table or work surface 12 to be ergonomically convenient for use by a packer (operator) in a production environment. Further, it is preferred that the device 10 is located closely adjacent to a pallet, a location for shipping pallets, a truck shipping dock or other location close to where the cartons are collected for shipping purposes.

Figure 9:
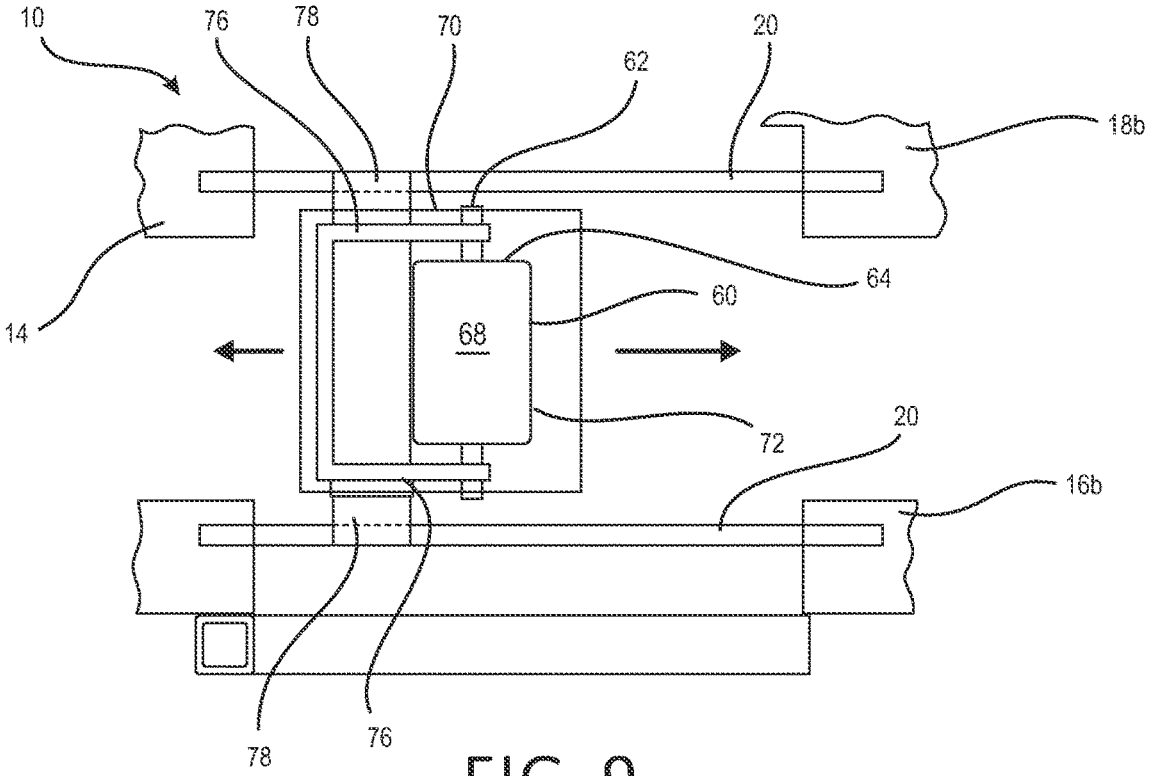
FIG. 9 is a schematic fragmentary front view of the device of FIG. 5.

Upon the work surface 12 is positioned a frame 14, including two spaced lower frame members 16*a*, 16*b*, and two spaced upper frame members 18*a*, 18*b*. In the preferred embodiment, the frame members 16*a*-18*b* are located in parallel arrangement and are made of steel "L"-bracket stock, but other materials and configurations are contemplated. A plurality of spaced, preferably parallel crossbars 20 are fixed to opposed upper flanges 22 of upper frame members 18*a*, 18*b*, such as being passed through corresponding throughbores 24 and held in place with suitable fasteners such as cotter pins, clips, by welding and the like. Similarly, lower flanges 26 of the lower frame members 16*a*, 16*b* are held together by a similar plurality of spaced crossbars 20 (FIG. 9). Vertical spacing between the lower frame members 16*a*, 16*b* and the corresponding upper frame members 18*a*, 18*b* is maintained by at least one and preferably a plurality of vertical posts 28 connecting opposing lateral flanges 30 using fasteners 32 such as bolts, rivets, welding or the like.

Figure 1:
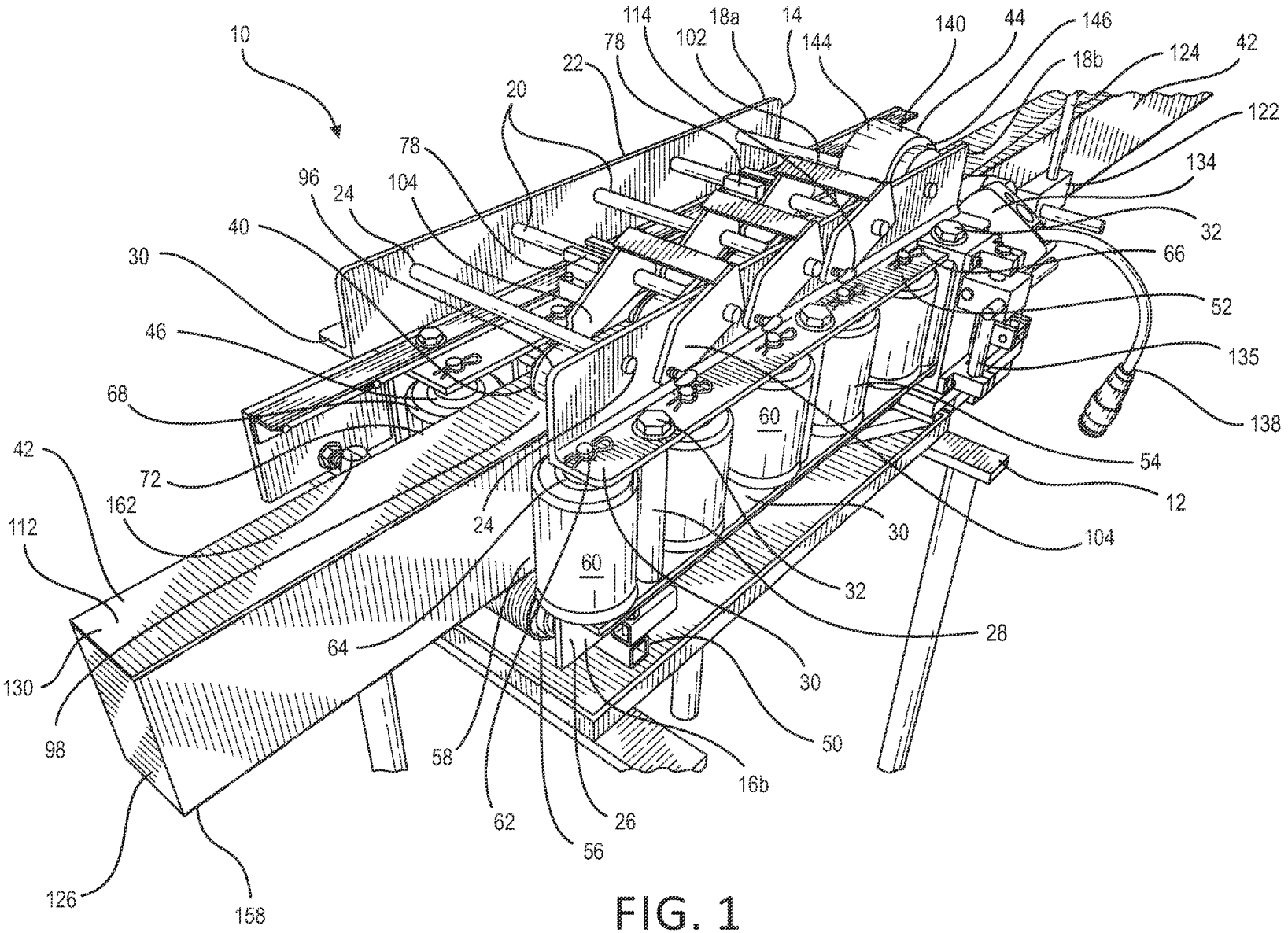
FIG. 1 is a rear perspective view of the present automated carton closing and conveying device showing a finished carton being conveyed.
Figure 4:
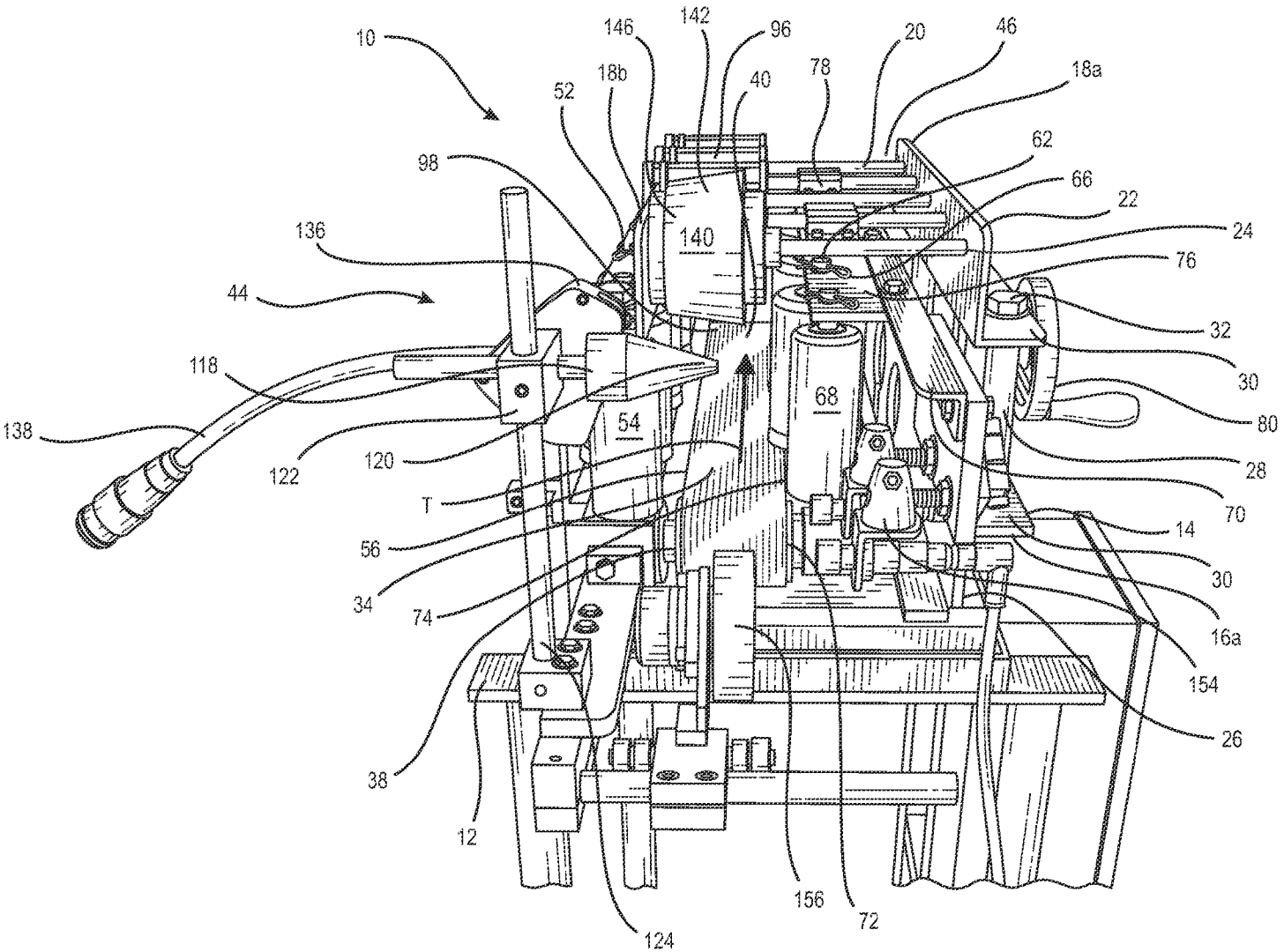
FIG. 4 is a front perspective view of the present device opposite the view shown in FIG. 1.
Figure 5:
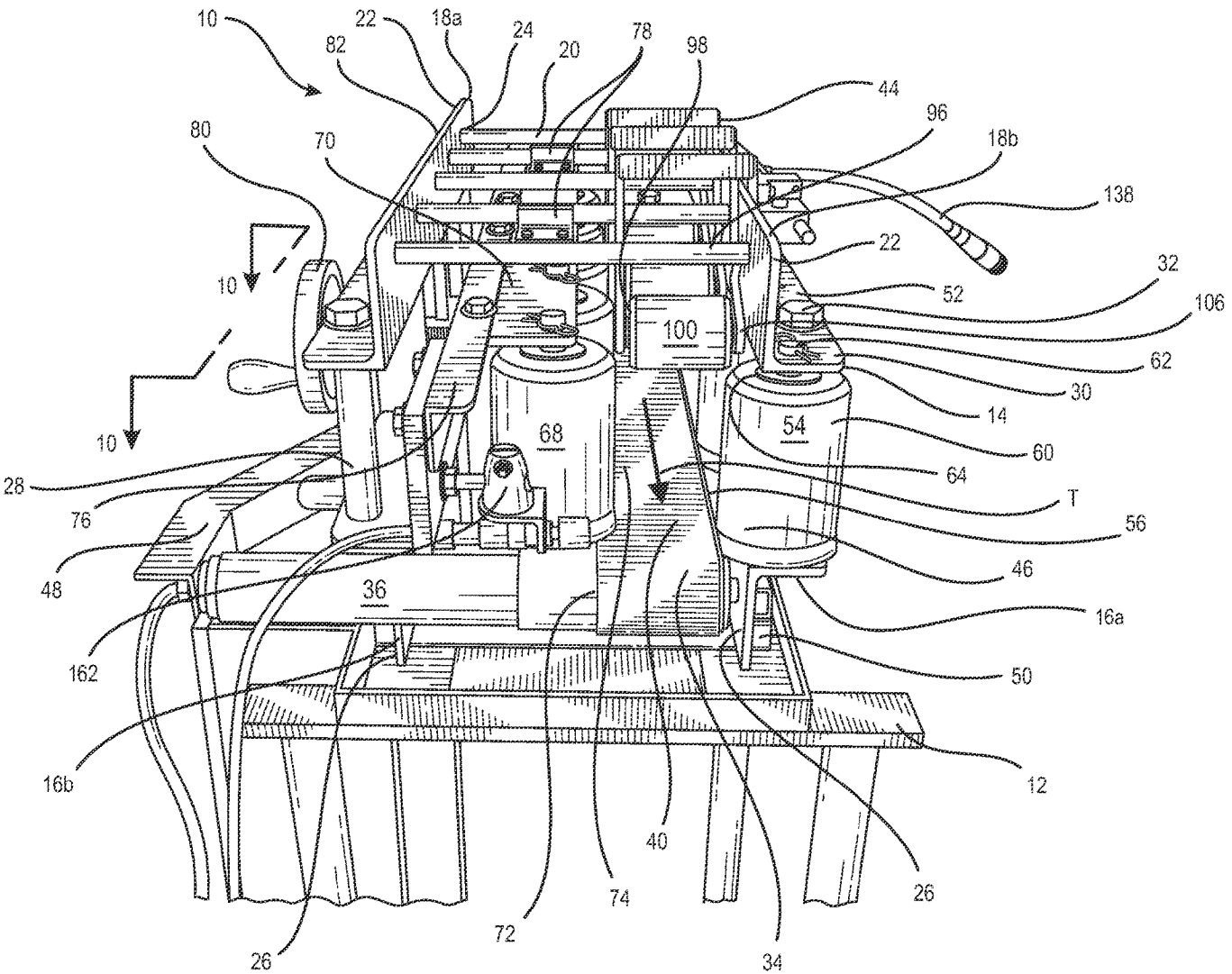
FIG. 5 is a rear end perspective view of the present device.

Referring now to FIGS. 1, 4 and 5, an endless conveyor belt 34 is looped around a combined drive motor and roller 36 and at least one idler roller 38. While a variety of such rollers are contemplated, a suitable model is available from Interroll Corporation, Wilmington, N.C. The belt 34 operates in a direction of travel "T", and defines a track 40 through which cartons 42 are conveyed during the present forming and sealing operations. In the present device 10, the cartons 42 are inserted at an inlet end 44 of the track 40, also the preferred location of the idler roller 38, and exit at an outlet end 46, the preferred location of the drive motor and roller 36. A suitable support bracket 48 (FIG. 5) connected to the lower frame member 16*b* supports the drive motor 36. Also, transverse cross members 50 are provided to support the lower frame members 16*a*, 16*b* and provide attachment points for other supplemental brackets as described below.

Referring now to FIGS. 1-5, frame members 16*b* and 18*b* are combined to form a first bracket 52, which during operation of the device 10 is fixed, and which also is provided with a first plurality of linearly arranged, spaced rollers 54. While other arrangements are contemplated, the rollers 54 are linearly spaced along one side 56 of the conveyor belt 34 and thus define a first side 58 of the track 40. Further, the rollers 54 are preferably vertically positioned on the frame 14, and are made of a durable material, such as steel and having a polished, low-friction exterior surface 60. Each roller 54 rotates on a spindle 62 and rotation is facilitated by bearings 64 as are well known in the art. To facilitate disassembly of the device 10, the spindles 62 are secured to the flanges 30 using spring clips 66 or the like. Similar clips 66 also retain the crossbars 20 in place.

Referring now to FIGS. 3, 4, 6, 9 and 10, a second plurality of rollers 68 is provided in a linear arrangement, similar to the first plurality of rollers 54, and the rollers 68 are preferably identical to the rollers 54. A second bracket 70 retains the second plurality of rollers 68 in similar fashion to the first bracket 52. Also, the second plurality of rollers 68 are situated along a second side 72 of the conveyor belt 34 and define a second side 74 of the track 40 (FIG. 4). An important distinction of the second bracket 70 is that it is transversely movable relative to the track 40 for adjusting the track width and as such allows the device 10 to accommodate cartons 42 having different widths.

In the preferred embodiment, the second bracket 70 is "C" or "["-shaped, with the second plurality of rollers 68 held between upper and lower flanges 76 (FIG. 9). Support for the second bracket 70 and for maintaining a desired parallel alignment with the conveyor belt 34, is provided by at least one and preferably a plurality of linear sliding bearings 78 which are secured to the bracket and slidingly engage respective crossbars 20 on both the upper frame members 18*a*, 18*b* and the lower frame members 16*a*, 16*b*. In the preferred embodiment, there are two linear sliding bearings 78 associated with the upper frame members 18*a*, 18*b*, and four linear sliding bearing associated with lower frame members 16*a*, 16*b*, however the number may vary to suit the application.

Figure 8:
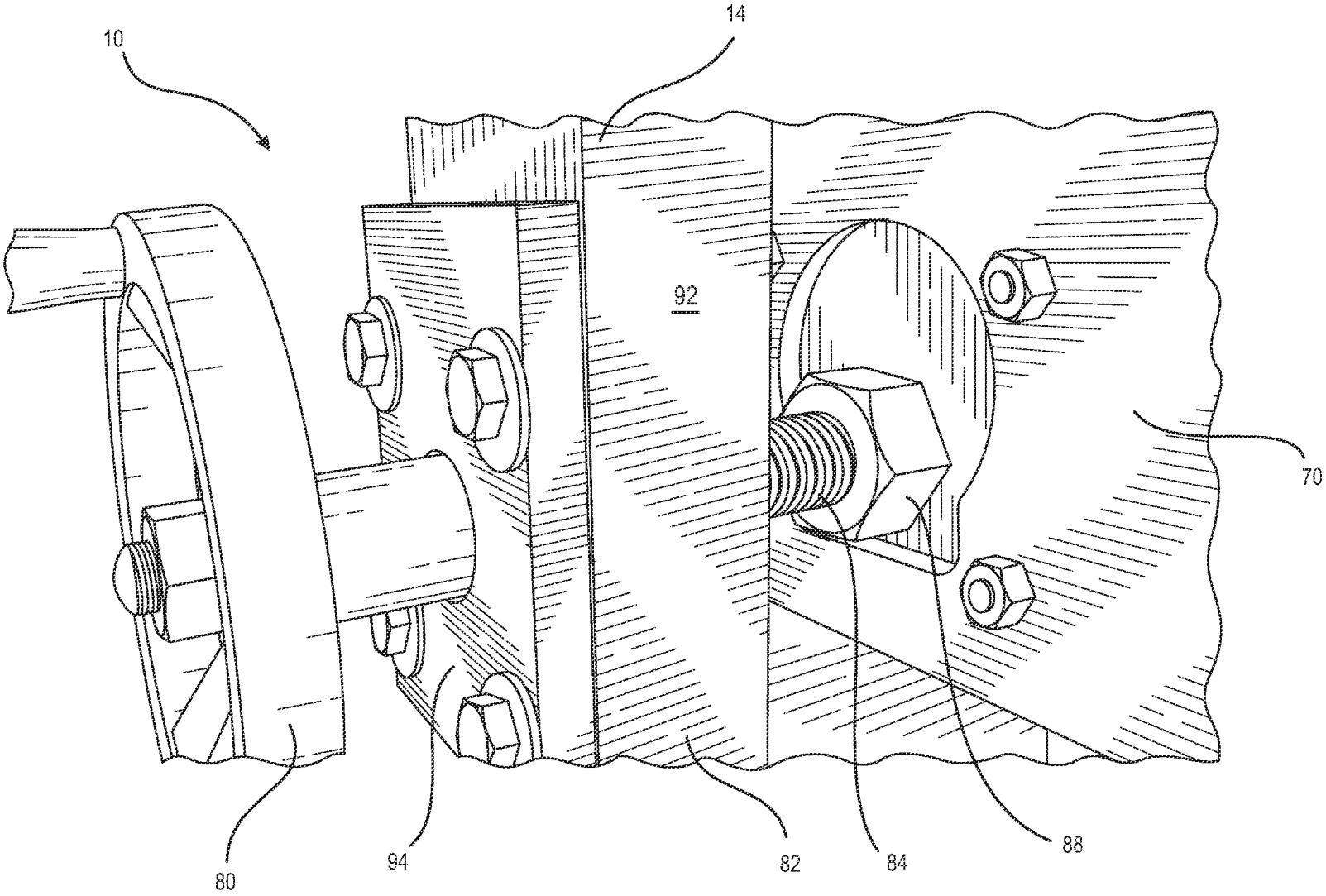
FIG. 8 is a fragmentary enlarged side elevation of the present device.
Figure 10:
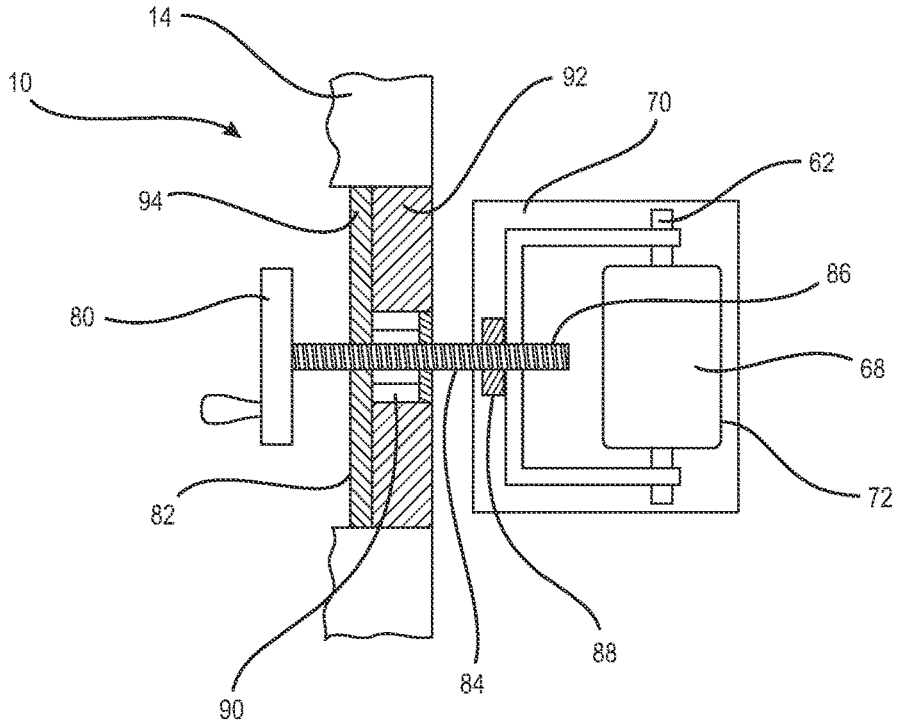
FIG. 10 is a schematic of a vertical section taken along the lines 10-10 of FIG. 5.

Referring now to FIGS. 8 and 10, transverse movement of the second bracket 70 and the second plurality of rollers 68 is achieved under packer control using an adjustment wheel 80 located on a side 82 of the frame opposite the first bracket 52 and connected to an elongate threaded rod 84. A free end 86 of the threaded rod 84 opposite the adjustment wheel 80 threadably engages a nut 88 fixed to the second bracket 70. Between the free end 86 and the adjustment wheel 80, the threaded rod 84 is rotatably supported in a bearing 90 located in a support plate 92 of the frame 14. The rod 84 is also rotatably supported by a frame cover plate 94. Accordingly, in operation, rotation of the adjustment wheel 80 causes transverse movement of the second plurality of rollers 68 relative to the track 40.

Referring now to FIGS. 3-6, also included on the device 10 is a third plurality of linearly aligned rollers 96 defining an upper end 98 of the track 40. Unlike the first and second pluralities of rollers 54 and 68, the third plurality of rollers 96 is oriented with the exterior surface 100 positioned generally horizontally, and each roller is connected to the frame 14 using an associated pivot bracket 102. Each pivot bracket 102 is generally "U"-shaped, having free ends 104 capturing roller spindles 106 (FIG. 5). Also, each pivot bracket 102 is pivotally secured to the frame 14 by being pivotally and slidably attached to a corresponding crossbar 20.

By locating a crossbar bore 108 (FIG. 6) near an end 110 of the bracket 102 opposite the roller 96, the roller becomes weighted and exerts a force on a top 112 of the carton 42 as it moves along the track 40 from the inlet end 44 to the outlet end 46 (FIG. 1). Optionally, thumbscrews 114 on the pivot bracket 102 are used to engage the upper frame member 18*a* to retard the pivoting movement, or if tightened, to hold the rollers 96 in a desired position relative to the track 40. Thus, the track 40 is defined by the conveyor belt 34, the first and second pluralities of rollers 54, 68 defining the sides, and the rollers 96 defining a top 116 of the track. Through the adjustment of the rollers 68 and 96, the track 40 is dimensioned to snugly yet slidably accommodate travel of the cartons 42 from the inlet end 44 to the outlet end 46.

Referring now to FIGS. 2, 3, 4 and 7, another feature of the present device 10 is the ability to automatically form and seal flaps of a subject carton 42 as it is being moved toward a desired shipping location. A flap opener 118 is provided, preferably a tapered roller with a tip 120 (FIG. 4) pointing from the first plurality of rollers 54 to an interior of the track 40 and widens in a cone-like shape from the tip. Preferably, the flap opener 118 is mounted to the frame 14 adjacent the fixed plurality of rollers 54 using a supplemental bracket 122 and a generally vertical rod 124.

Figure 2:
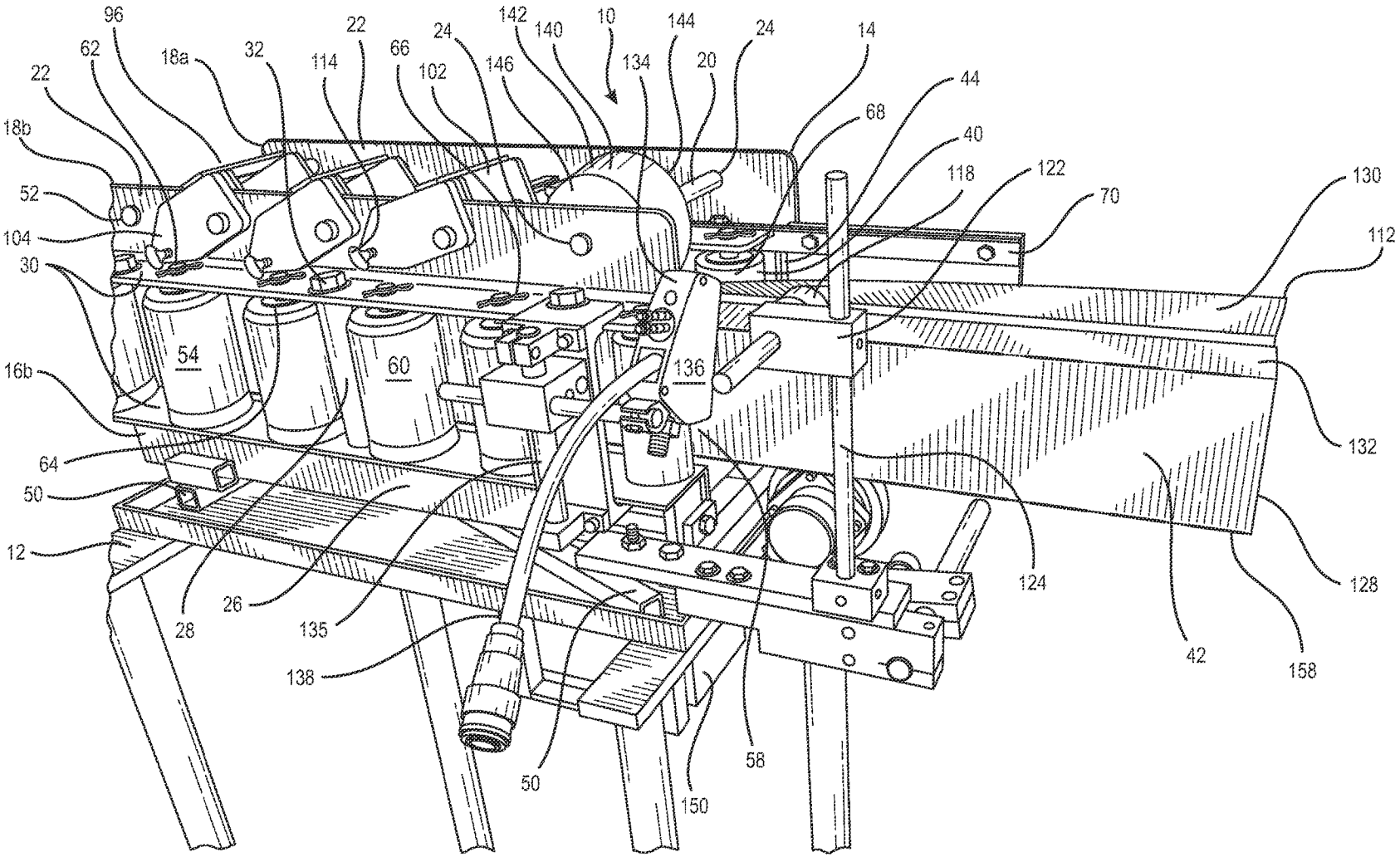
FIG. 2 is a fragmentary rear perspective view of the present device showing an unfinished carton being inserted into the inlet end.

In operation, the carton 42 is pre-formed at first and second ends 126 (FIG. 1), 128 (FIG. 2), and loaded with product by the packer before entering the track 40, the carton has a top flap 130 and a next adjacent flap 132 (FIG. 2). Next, the carton 42 is inserted into the inlet end 44 of the track 40 and the packer manipulates the carton so that the top flap 130 is temporarily elevated and held away from the next adjacent flap 132 by the flap opener 118 (Best seen in FIG. 2). Movement of the conveyor belt 34 pulls the carton 42 through the track 40. As the carton 42 passes the flap opener 118, a gluing fixture 134 is associated with the frame 14 and injects adhesive onto the next adjacent flap 132 in an area between the flaps made accessible by the operation of the flap opener. In the preferred embodiment, the gluing fixture 134 is secured to the frame 14 by a vertical support post 135 (FIG. 3), however other mounting arrangements are contemplated, provided that the fixture is in operational relationship to the top flap 130 and the next adjacent flap 132 as the carton 42 passes through the track 40.

Figure 3:
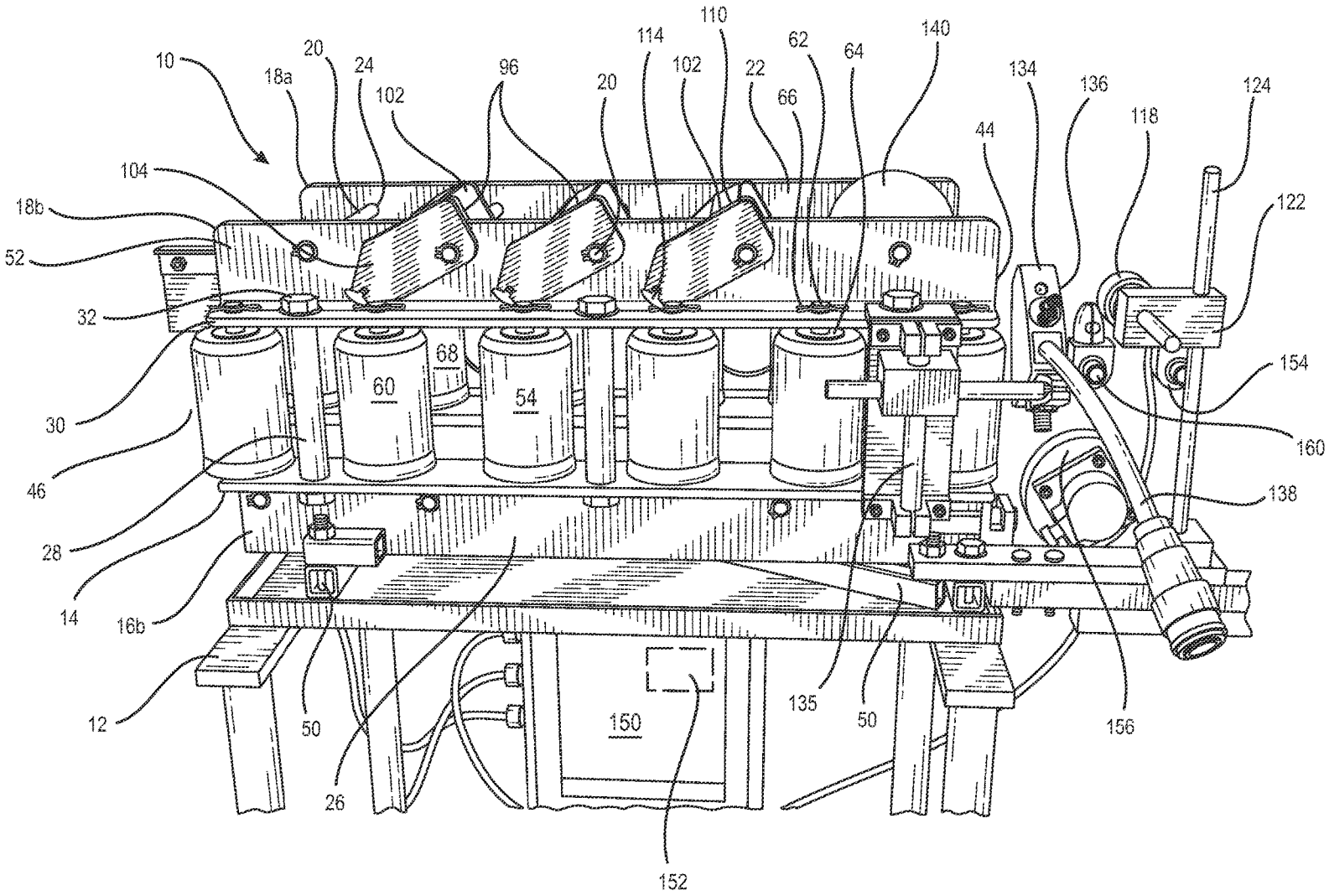
FIG. 3 is a side elevation of the present device.

Referring now to FIGS. 2 and 3, while a number of conventional gluing fixtures 134 are considered suitable, one such apparatus is provided by ITW Dynatec, Hendersonville, Tenn., www.itwdynatec.com. As is known in the art, the gluing fixture 134 includes an adhesive injector 136 which is fed heated adhesive through a transport hose 138. A remote reservoir of adhesive (not shown) is in fluid communication with the transport hose 138.

Referring now to FIGS. 1, 4, 6 and 7, next downstream, or past the gluing fixture 134 in the direction of travel "T" is a pressing fixture 140 associated with the frame 14 and configured for pressing the top flap 130 against the next adjacent flap 132 for sealing the cartons 42 as they pass through the track 40. In the preferred embodiment, the pressing fixture 140 is a pressing roller mounted to one of the upper frame members 18*a*. 18*b* and is located upstream of the third plurality of linearly aligned rollers 96. Also, the pressing fixture has an inclined exterior 142 with a relatively larger diameter compared to the diameters of the third plurality of rollers 96. In addition, the pressing fixture 140 has a larger diameter on an outer edge 144 which is closer to the track 40 than to the frame member 18, and a smaller diameter on an inner edge 146 (FIG. 6) closer to the frame member.

In function, the pressing fixture 140 serves a transition role that begins the process of forming the top flap 130 and the next adjacent flap 132 gradually to prevent the formation of creases. The inclined exterior 142 engages the top flap 130 after the injection of adhesive and gradually, gently moves the top flap 130 to a desired closed position. While other materials are contemplated, the pressing fixture 140 is made of UHMW plastic.

Referring again to FIG. 6, once the carton 42 reaches the third plurality of rollers 96, the carton sealing process begins, as the plurality of rollers 96, which are at least three rollers in linear sequence along the track 40, exert a downward pressing force on the top flap 130 as the carton 42 is securely held in place by the first and second pluralities of rollers 54, 68 so that the carton is held in a properly aligned or "squared" position as the adhesive dries or sets.

Referring now to FIG. 1, once the carton 42 is moved by the conveyor belt 34 past the outlet end 46, the adhesive is sufficiently dried to retain the carton in position. Further movement of the conveyor belt 34 transports the completed, sealed carton 42 to a desired location for stacking prior to shipment.

Referring now to FIG. 3, another feature of the device 10 is a control system, generally designated 150, which monitors the movement of the carton 42 through the track 40, and among other things, prevents the injection of adhesive by the adhesive injector 136 when a carton is not present in the track 40. More specifically, the control system 150 includes a control circuit or processor 152 (shown hidden), located on or near the frame 14 of the device 10, and is electrically connected to the drive motor 36, the adhesive injector 136 as well as to the components described below. Such control circuits or processors 152 are well known in the art and are preferably programmable.

Referring now to FIGS. 3 and 4, more specifically, the control system 150 includes a first sensor 154 electrically connected to the drive motor 36 to initiate movement of the conveyor belt 34 upon one carton 42 being inserted into the inlet end 44 of the track 40. An encoder 156, preferably a rotary encoder, is located near the conveyor belt 34 at the inlet end 44 of the track 40 and is configured for rotatably engaging a lower flap 158 (FIG. 2) of the carton 42 for determining a speed of the carton passing through the track. In the preferred embodiment, the encoder 156 is spring-biased so that it is depressed upon the insertion of the carton 42 in the track 40, and presses against the lower flap 158 as the carton is inserted into the track. In addition, a leading portion of the encoder 156 is located between the first sensor 154 and a second sensor 160 located downstream of the encoder and of the first sensor for sending an injection signal through the control circuit 152 upon receipt of signals from the first sensor, the encoder and the second sensor to the gluing fixture 134 for injecting adhesive. In this manner, adhesive is only injected in the presence of a carton 42 in the track 40.

Figure 6:
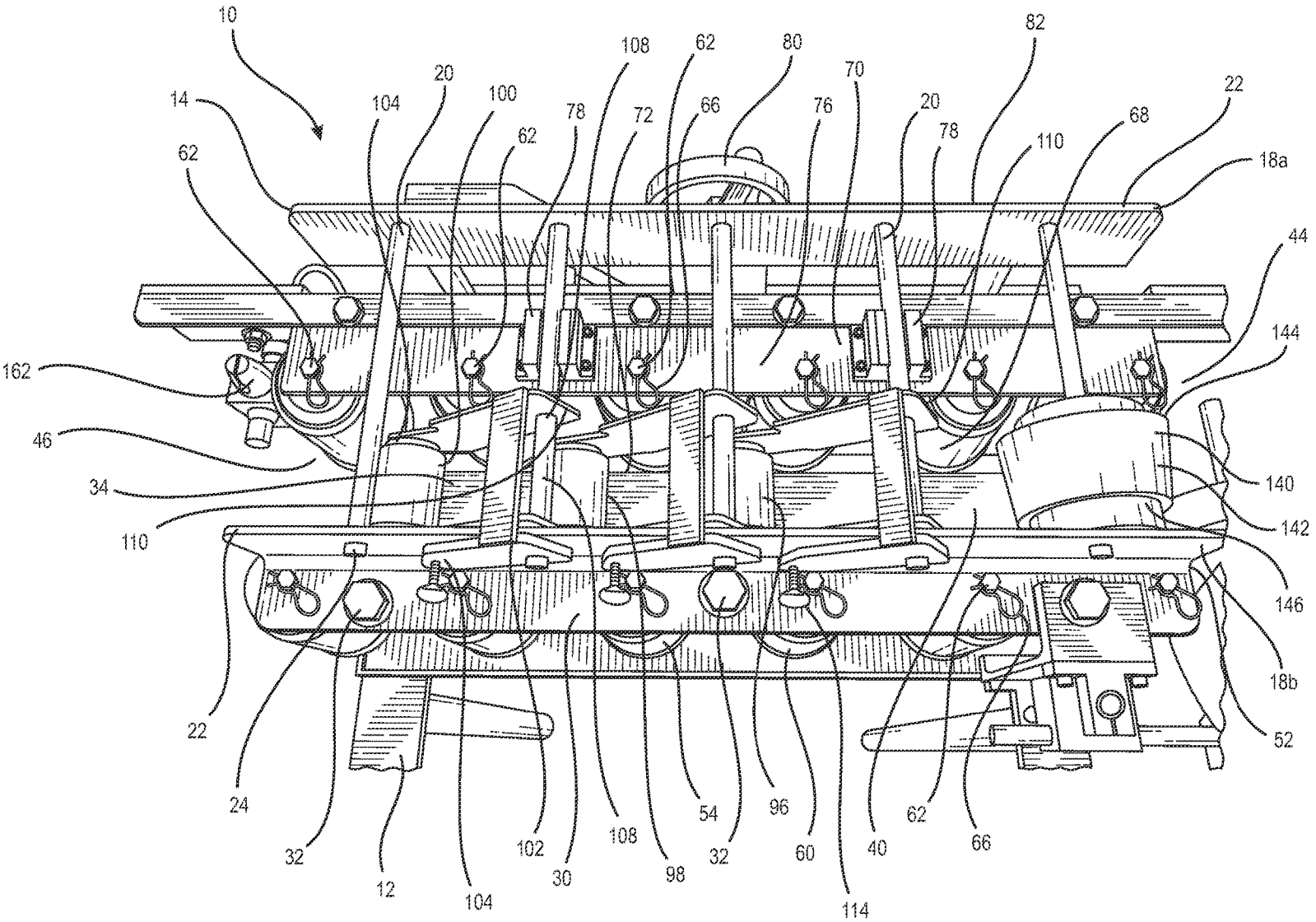
FIG. 6 is a top perspective view of the present device.
Figure 7:
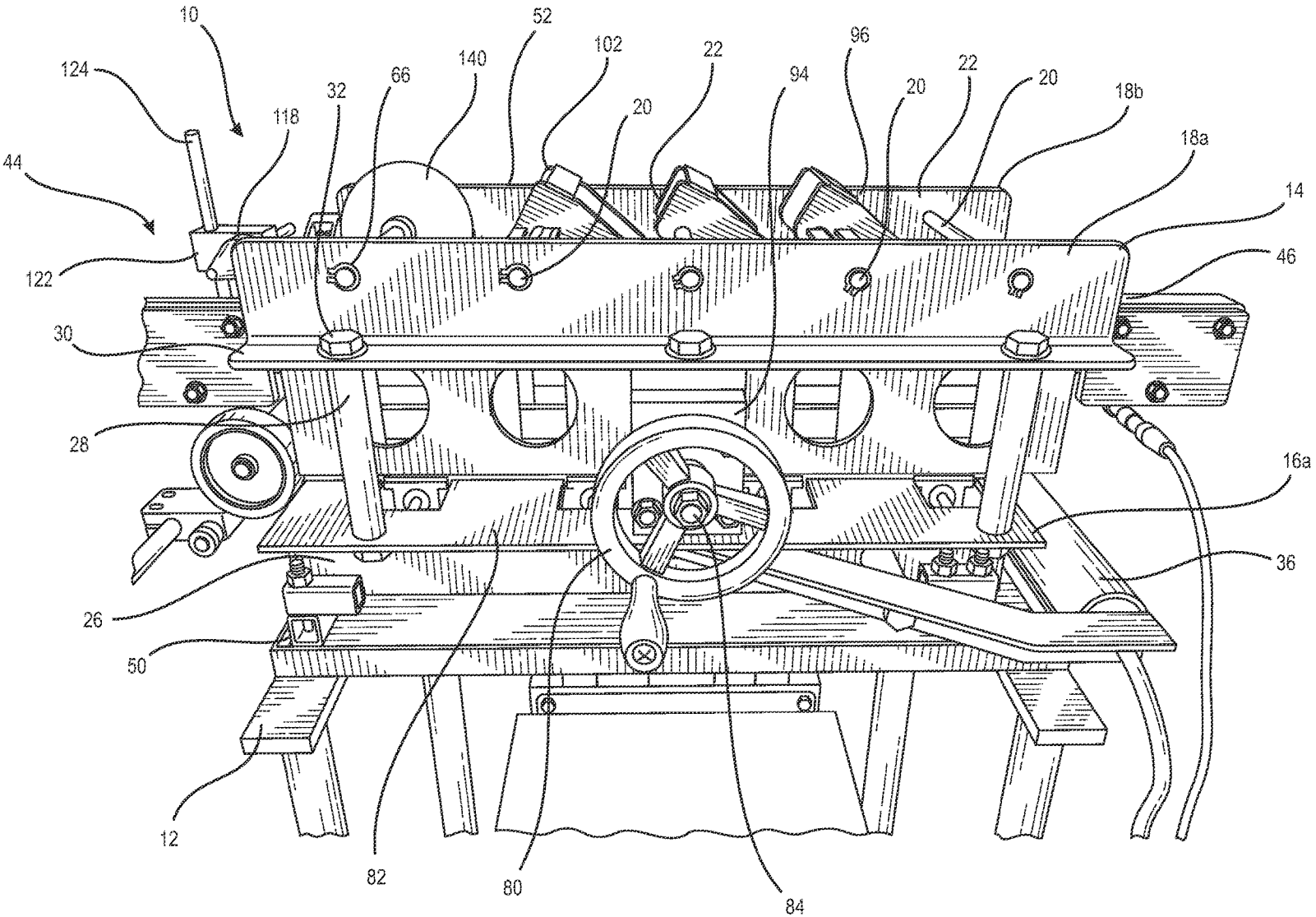
FIG. 7 is a side perspective view opposite the view shown in FIG. 3.

In the preferred embodiment, the first and second sensors 154, 160 are secured to, or otherwise associated with the frame 14, are optical sensors, and with the encoder 156, are connected to the control circuit 152. Referring now to FIGS. 1, 5 and 6, adjacent the outlet end 46 of the track 40, a third sensor 162, also preferably an optical sensor, is associated with the frame 14 and is electrically connected to the control circuit 152 and to the conveyor belt drive motor 36. As the rear or second end 128 (FIG. 2) of the carton 42 is driven by the conveyor belt 34 passes the third sensor 162, the drive motor 36 is turned off. Similarly, as the rear end 128 passes the second sensor 160 at the track inlet end 44, the adhesive injector 136 is turned off so the flow of adhesive is controlled.

While a particular embodiment of the present automated carton closing and conveying device has been described herein, it will be appreciated by those skilled in the art that changes and modifications may be made thereto without departing from the invention in its broader aspects and as set forth in the following claims.

What is claimed is:

1. A device for closing, sealing and conveying corrugated cartons having a top flap and a next adjacent flap, comprising:

a frame;

a moving conveyor belt associated with said frame and defining a track with an inlet end and an outlet end;

a fixed bracket secured to said frame and having a first plurality of rollers linearly aligned along a direction of travel of said conveyor belt defining a first side of said track;

a movable bracket associated with said frame, having a second plurality of rollers linearly aligned along the direction of said conveyor belt defining a second side of said track and being transversely movable relative to said fixed bracket under operator control;

a control system associated with said frame, located adjacent said track inlet end, and being electrically connected to a gluing fixture so that said gluing fixture only injects adhesive in the presence of a carton in said track; and the control system includes a first sensor connected to a drive motor to initiate movement of said conveyor belt upon one carton of said cartons being inserted into said inlet end of said track, an encoder configured for determining a speed of the carton passing through the track, and a second sensor located downstream of said encoder, said control system configured for sending an injection signal upon receipt of signals from said first sensor, said encoder, and said second sensor being sent to said gluing fixture to inject adhesive.

2. The device of claim 1, further including a third plurality of rollers linearly aligned along the direction of travel of the conveyor belt and defining an upper end of said track and constructed and arranged for contacting the corrugated cartons as they move along the track from said inlet end to said outlet end.

3. The device of claim 2, wherein at least one of said third plurality of rollers is pivotable relative to said track and exerts a weighted force on the cartons.

4. The device of claim 1, further including a flap opener associated with said frame and located upstream said inlet end of said conveyor belt for temporarily elevating a top flap of the cartons passing through said track.

5. The device of claim 4, wherein said flap opener is a tapered roller.

6. The device of claim 4, wherein the gluing fixture is associated with said frame and located downstream of said flap opener for injecting adhesive between said top flap and next adjacent flap into the cartons as the cartons pass through said track.

7. The device of claim 6, further including a pressing fixture associated with said frame and located downstream of said gluing fixture for pressing the top flap against the next adjacent flap for sealing the cartons as they pass through said track.

8. The device of claim 7, wherein said pressing fixture is a pressing roller located upstream of a third plurality of rollers linearly aligned along the direction of travel of the conveyor belt and defining an upper end of said track and constructed and arranged for contacting the corrugated cartons as they move along the track from said inlet end to said outlet end, said pressing roller having an inclined exterior and a relatively larger diameter compared to said third plurality of rollers.

9. The device of claim 1, further including a third sensor located adjacent said outlet end of said track.

10. The device of claim 9, wherein said first, said second and said third sensors are optical sensors.

11. A device constructed and arranged for receiving, sealing, and transitioning an elongate carton, comprising:

a conveyor belt defining a track having an inlet end and an outlet end;

a first plurality of vertical rollers defining a first side of said track;

a second plurality of vertical rollers defining a second side of said track, said pluralities of vertical rollers configured for aligning cartons inserted in said track;

a flap opener associated with said inlet end of said track;

a gluing fixture located downstream of said flap opener;

a pressing fixture located downstream of the gluing fixture, the pressing fixture is a pressing roller located upstream of a third plurality of rollers linearly aligned along a direction of travel of the conveyor belt and defining an upper end of said track and constructed and arranged for contacting the corrugated cartons as they move along the track from said inlet end to said outlet end, said pressing rover having an inclined exterior and a relatively larger diameter compared to said third plurality of rollers;

a frame;

a first bracket fixed to said frame and accommodating said first plurality of rollers;

a second bracket associated with said frame and accommodating said second plurality of rollers; and an adjustment wheel associated with said frame and connected to a threaded rod passing through said frame and threadably engaging said second bracket so that rotation of said adjustment wheel causes transverse movement of said second plurality of rollers relative to said first bracket.

12. The device of claim 11, wherein said second plurality of rollers is adjustable in a direction transverse to the direction of travel of said conveyor belt.

13. The device of claim 11, further including a control system, located adjacent said track inlet end, and being electrically connected to said gluing fixture so that said gluing fixture only injects adhesive in the presence of a carton in said track.

14. The device of claim 13, wherein said control system includes a first sensor connected to a drive motor to initiate movement of said conveyor belt upon the carton being inserted into said inlet end of said track, an encoder configured for determining a speed of the carton passing through the track, and a second sensor located downstream of said encoder, said control system configured for sending an injection signal upon receipt of signals from said first sensor, said encoder, and second sensor being sent to said gluing fixture to inject adhesive.

15. A device for closing, sealing and conveying corrugated cartons having a top flap and a next adjacent flap, comprising:

a frame;

a moving conveyor belt associated with said frame and defining a track with an inlet end and an outlet end;

a fixed bracket secured to said frame and having a first plurality of rollers linearly aligned along a direction of travel of said conveyer belt and defining a first side of said track;

a movable bracket associated with said frame, having a second plurality of rollers linearly aligned along the direction of travel of said conveyer belt and being transversely movable relative to said fixed bracket under operator control;

a flap opener associated with said frame and located upstream said inlet end of said for temporarily elevating a top flap of the cartons passing through said track;

a gluing fixture associated with said frame and located downstream of said flap opener for injecting adhesive between said top flap and a next adjacent flap into the cartons beneath the upper flap as the cartons pass through said track;

a pressing fixture associated with said frame and located downstream of said gluing fixture for pressing the top flap against the next adjacent flap for sealing the cartons as they pass through said track; and the pressing fixture is a pressing roller located upstream of a third plurality of rollers linearly aligned along the direction of travel of the conveyor belt and defining an upper end of said track and constructed and arranged for contacting the corrugated cartons as they move along the track from said inlet end to said outlet end, said pressing roller having an inclined exterior and a relatively larger diameter compared to said third plurality of rollers.

* * * * *